US007984833B2

(12) United States Patent
Fang

(10) Patent No.: US 7,984,833 B2
(45) Date of Patent: Jul. 26, 2011

(54) FLUID DISPENSER

(76) Inventor: Kuo-Chung Fang, Tainan (TW)

( * ) Notice: Subject to any disclaimer, the term of this patent is extended or adjusted under 35 U.S.C. 154(b) by 544 days.

(21) Appl. No.: 12/145,062

(22) Filed: Jun. 24, 2008

(65) Prior Publication Data

US 2009/0001102 A1 Jan. 1, 2009

(30) Foreign Application Priority Data

Jun. 27, 2007 (TW) ..... 96123277 A

(51) Int. Cl.
*G01F 11/00* (2006.01)

(52) U.S. Cl. ..... 222/260; 222/321.7

(58) Field of Classification Search ..... 222/260, 222/402, 256, 383.1, 383.2, 340, 386, 387, 222/280, 321.1, 321.7, 321.9, 402.1, 402.13, 222/492–496, 522, 505, 507
See application file for complete search history.

(56) References Cited

U.S. PATENT DOCUMENTS

| | | | | |
|---|---|---|---|---|
| 3,102,489 | A * | 9/1963 | Cooprider et al. | 417/560 |
| 3,777,947 | A * | 12/1973 | Klema | 222/402.23 |
| 3,785,532 | A | 1/1974 | Cooprider | |
| 4,684,044 | A * | 8/1987 | Foster | 222/386 |
| 4,949,875 | A * | 8/1990 | Kuo | 222/156 |
| 6,202,899 | B1 * | 3/2001 | Lasserre et al. | 222/402.1 |

FOREIGN PATENT DOCUMENTS

GB 930015 A 7/1963

OTHER PUBLICATIONS

UK Intellectual Property Office, Combined Search and Examination Report, 2 pages.

* cited by examiner

*Primary Examiner* — Lien T Ngo
(74) *Attorney, Agent, or Firm* — Schwabe, Williamson & Wyatt, P.C.

(57) ABSTRACT

A fluid dispenser includes: a container defining a chamber; a discharging tube defining a fluid passage and having an outlet disposed outwardly of the chamber; a movable valve body disposed outwardly of the chamber and sleeved and slidable on the discharging tube between first and second positions for blocking and unblocking the outlet of the discharging tube; and an urging member disposed outwardly of the fluid passage and biasing the movable valve body for restoring the movable valve body to the first position.

8 Claims, 8 Drawing Sheets

FLUID DISPENSER

CROSS-REFERENCE TO RELATED APPLICATION

This application claims priority of Taiwanese application no. 096123277, filed on Jun. 27, 2007.

BACKGROUND OF THE INVENTION

1. Field of the Invention

This invention relates to a fluid dispenser, more particularly to a fluid dispenser including an urging member disposed outwardly of a fluid passage, and a movable valve body for blocking and unblocking the fluid passage.

2. Description of the Related Art

Conventional fluid dispensers normally include a container defining a chamber therein, a tubular assembly extending into the chamber, defining a fluid path in fluid communication with the chamber for passage of a fluid from the chamber, and having an outlet tube, a cap mounted on the outlet tube for pushing the fluid out of the chamber through the fluid path, and a coil spring disposed in the fluid path and connected to the outlet tube for restoring the cap together with the outlet tube from a pressed position to a non-pressed position.

In use, since the coil spring is disposed within the fluid path and is exposed to the fluid, it is likely to contaminate the fluid. In addition, the outlet tube of the conventional fluid dispenser is normally unblocked and is constantly in fluid communication with the ambient air, which can cause deterioration of the fluid in the chamber.

SUMMARY OF THE INVENTION

Therefore, the object of the present invention is to provide a fluid dispenser that can overcome the aforesaid drawbacks associated with the prior art.

According to the present invention, a fluid dispenser comprises: a container defining a chamber adapted to receive a fluid therein; a discharging tube extending into the chamber, defining a fluid passage in fluid communication with the chamber, and having an outlet disposed outwardly of the chamber and in fluid communication with the fluid passage; a movable valve body disposed outwardly of the chamber and sleeved and slidable on the discharging tube relative to the container between a first position, in which the movable valve body blocks the outlet of the discharging tube, thereby preventing the fluid from flowing from the chamber through the fluid passage and the outlet of the discharging tube, and a second position, in which the movable valve body unblocks the outlet of the discharging tube, thereby permitting the fluid to pass from the chamber through the fluid passage and the outlet of the discharging tube; and an urging member disposed outwardly of the fluid passage and biasing the movable valve body for restoring the movable valve body to the first position.

BRIEF DESCRIPTION OF THE DRAWINGS

In drawings which illustrate embodiments of the invention.

DETAILED DESCRIPTION OF THE PREFERRED EMBODIMENTS

Figure 1:
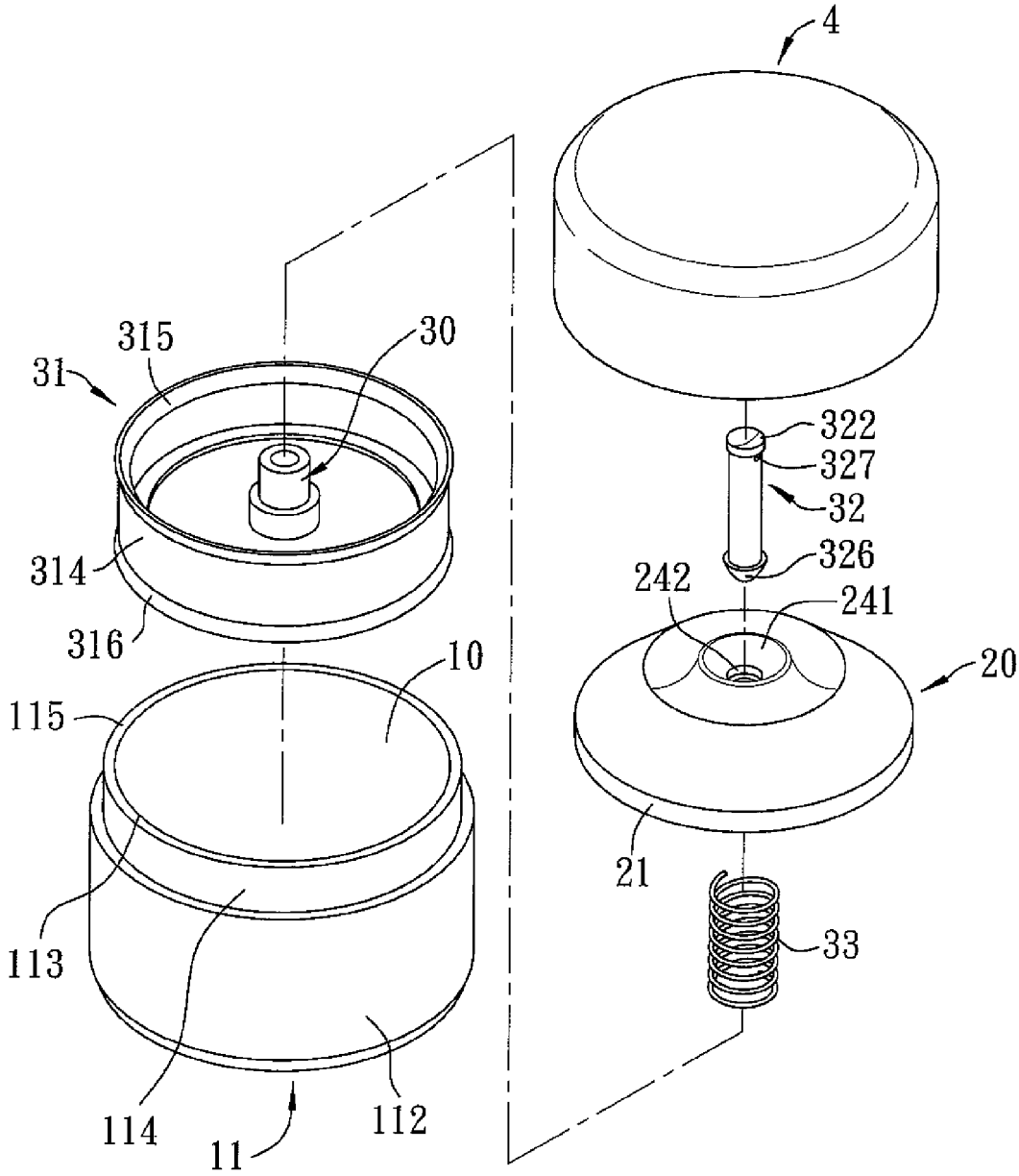
FIG. 1 is an exploded perspective view of the first preferred embodiment of a fluid dispenser according to this invention.
Figure 2:
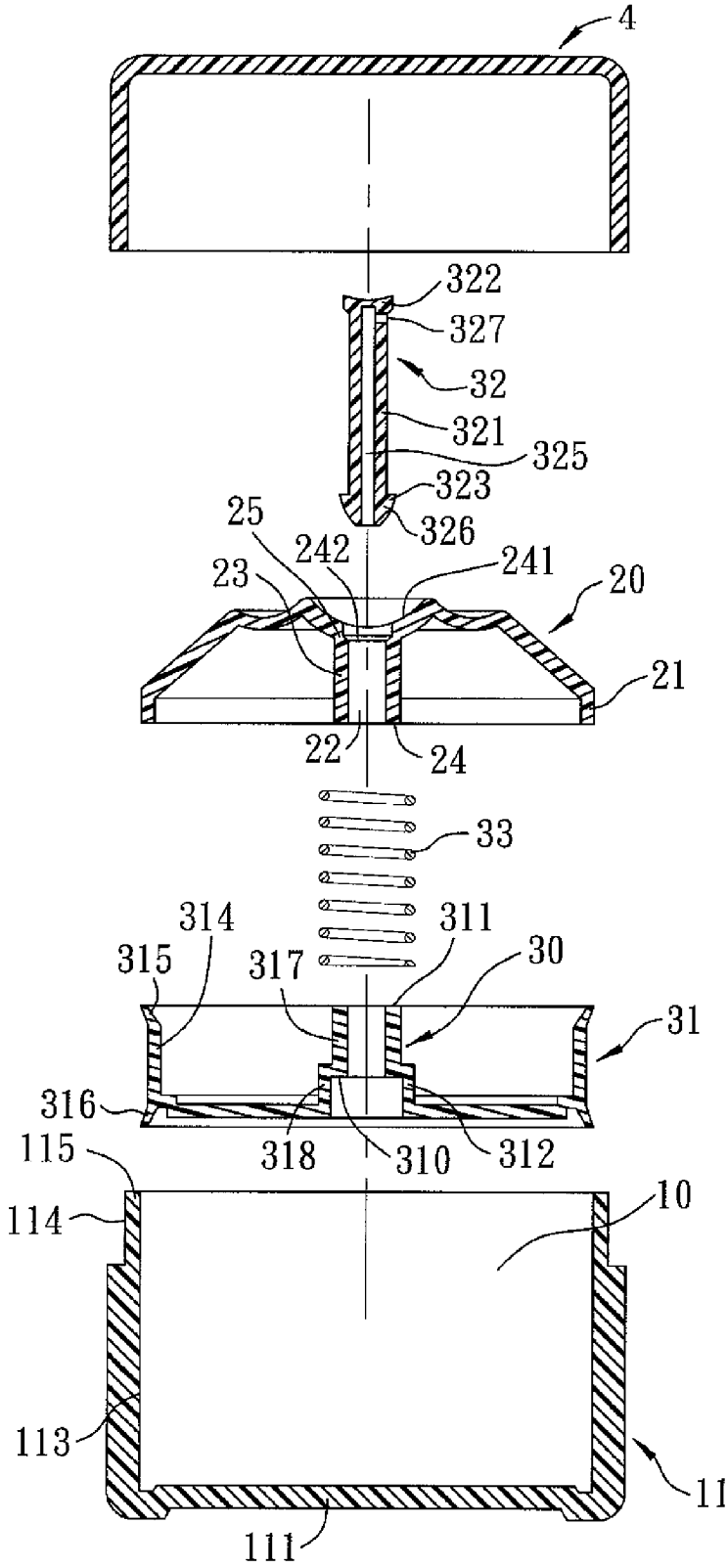
FIG. 2 is an exploded sectional view of the first preferred embodiment.
Figure 3:
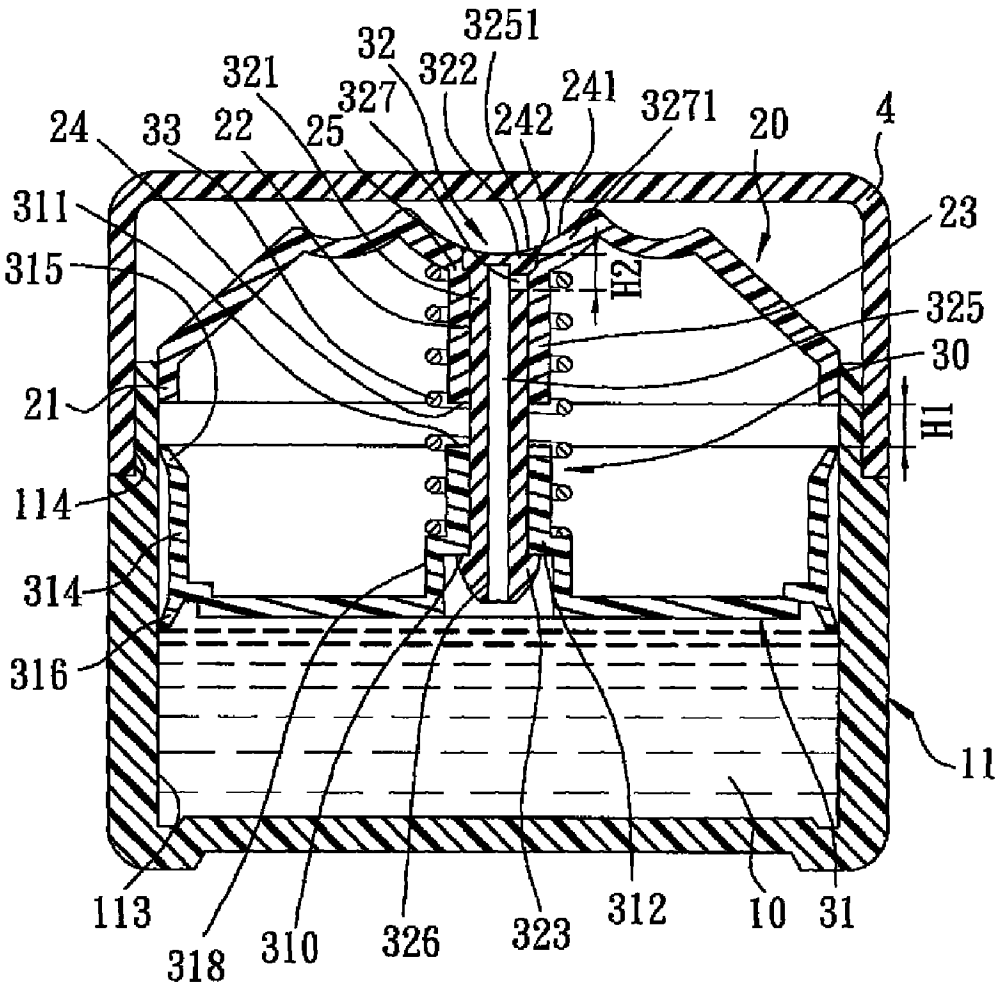
FIG. 3 is an assembled sectional view of the first preferred embodiment, illustrating a state where a movable valve body is disposed at a blocking position.
Figure 4:
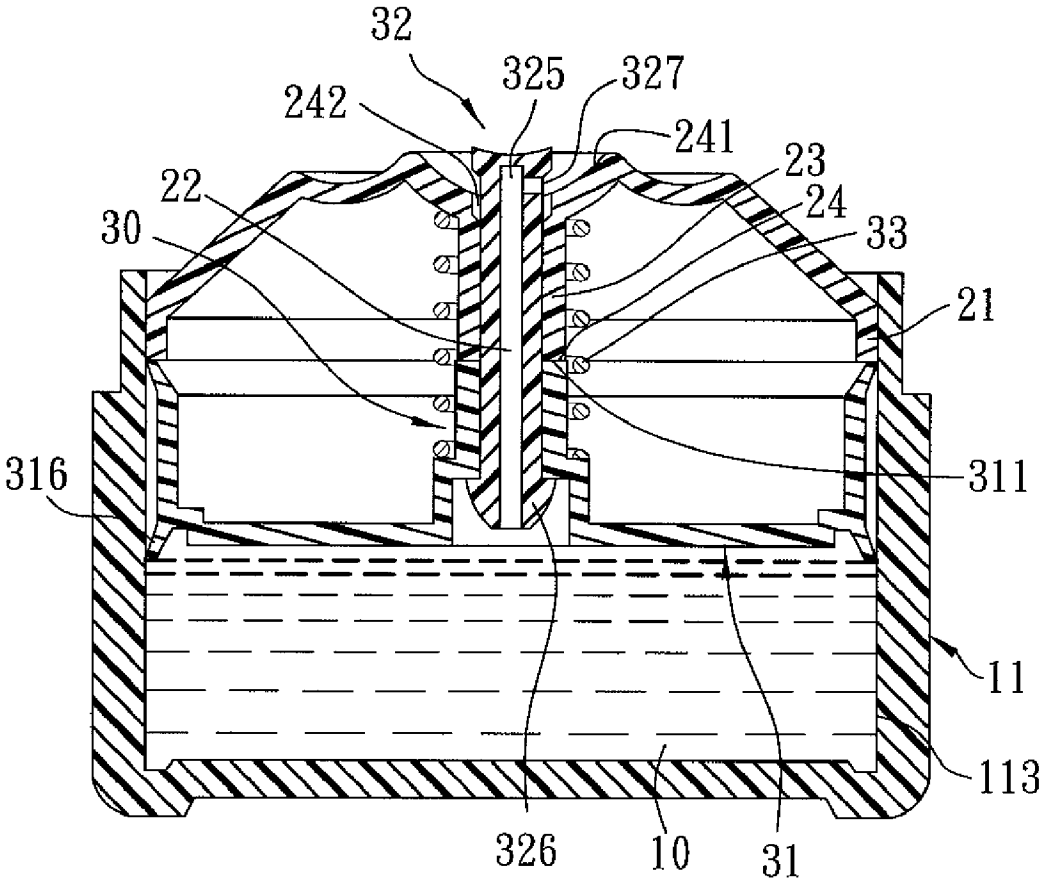
FIG. 4 is an assembled sectional view of the first preferred embodiment, illustrating another state where the movable valve body is disposed at an unblocking position.
Figure 5:
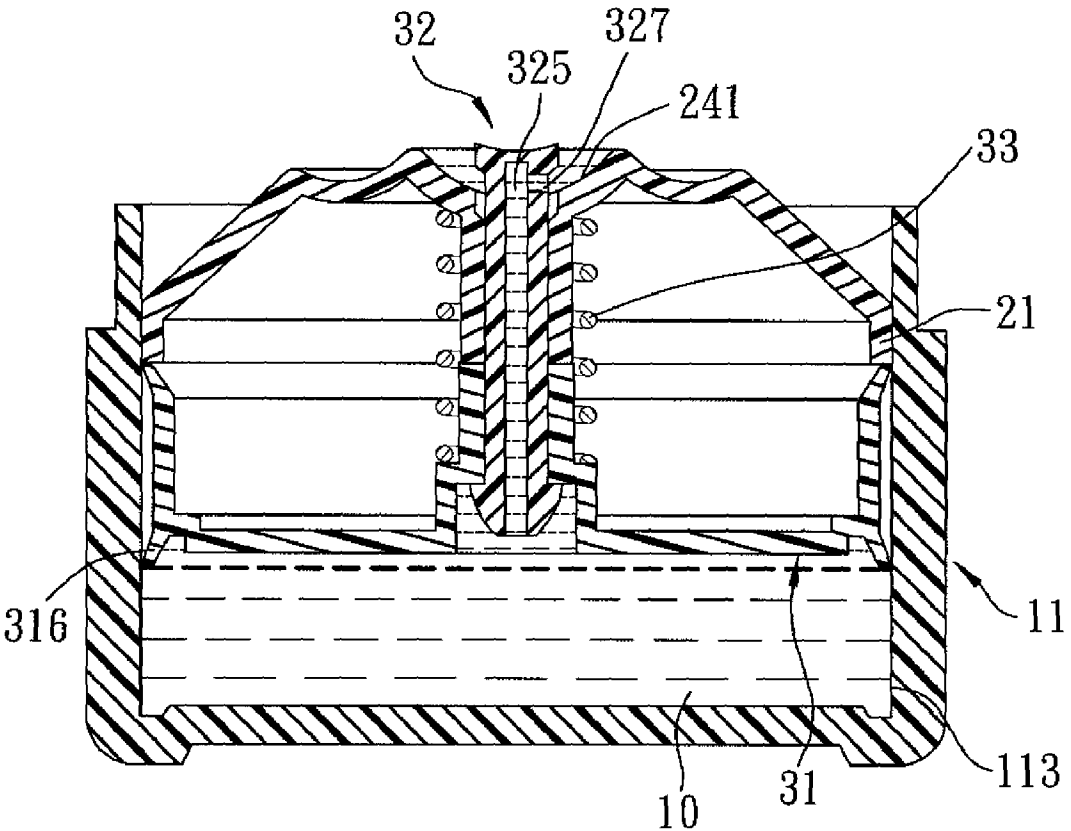
FIG. 5 is an assembled sectional view of the first preferred embodiment, illustrating yet another state where a press seat is pressed together with the movable valve body and a piston for driving a fluid through a fluid passage.

Before the present invention is described in greater detail with reference to the accompanying preferred embodiments, it should be noted herein that like elements are denoted by the same reference numerals throughout the disclosure.

FIGS. 1 to 5 illustrate the first preferred embodiment of a fluid dispenser according to this invention.

The fluid dispenser includes: a container 11 defining a chamber 10 adapted to receive a fluid therein; a discharging tube 32 extending into the chamber 10, defining a fluid passage 325 in fluid communication with the chamber 10, and having an outlet 327 disposed outwardly of the chamber 10 and in fluid communication with the fluid passage 325; a movable valve body 23 disposed outwardly of the chamber 10 and sleeved and slidable on the discharging tube 32 relative to the container 11 between a first position (see FIG. 3), in which the movable valve body 23 blocks the outlet 327 of the discharging tube 32, thereby preventing the fluid from flowing from the chamber 10 through the fluid passage 325 and the outlet 327 of the discharging tube 32, and a second position (see FIG. 4), in which the movable valve body 23 unblocks the outlet 327 of the discharging tube 32, thereby permitting the fluid to pass from the chamber 10 through the fluid passage 325 and the outlet 327 of the discharging tube 32; and an urging member 33 disposed outwardly of the fluid passage 325 and biasing the movable valve body 23 for restoring the movable valve body 23 to the first position.

In this embodiment, the container 11 has top and bottom ends 115, 111, and is provided with a piston 31 that is disposed movably in the container 11 between the top and bottom ends 115, 111 of the chamber 10, and that confines sealingly a top side of the chamber 10. The piston 31 is provided with a hollow plunger 30 extending therefrom and disposed outwardly of the chamber 10. The movable valve body 23 further has a lower end 24. The plunger 30 is sleeved on the discharging tube 32, and has an upper end 311 that is axially spaced apart and that is disposed below the lower end 24 of the movable valve body 23 when the movable valve body 23 is disposed at the first position (see FIG. 3), and that abuts against the lower end 24 of the movable valve body 23 when the movable valve body 23 is disposed at the second position (see FIG. 4).

In this embodiment, the plunger 30 includes an upper portion 317 sleeved on the discharging tube 32, and a lower portion 318 enlarged in cross section from and cooperating with the upper portion 317 to define a first shoulder 312 therebetween. The discharging tube 32 has a lower portion 326 disposed in the lower portion 318 of the plunger 30 and formed with a second shoulder 323 disposed below the first shoulder 312. The first shoulder 312 has an inner wall 310 abutting against the second shoulder 323.

Preferably, the urging member 33 is in the form of a coil spring 33 sleeved on the movable valve body 23 and the plunger 30 and abutting against the first shoulder 312.

The container 11 further has an inner wall 113. The piston 31 has a peripheral wall 314 having upper and lower skirts 315, 316 in sealing contact with the inner wall 113 of the container 11 so as to form a seal against leakage of the fluid from the chamber 10.

The movable valve body 23 further has an upper end 25. The fluid dispenser further includes a cap-like press seat 20 extending from the upper end 25 of the movable valve body 23 and having a central part 241 and a peripheral end 21 in sliding contact with the inner wall 113 of the container 11. The coil spring 33 abuts against the central part 241.

The movable valve body 23 defines an inner space 22 that has an enlarged upper end 242. The discharging tube 32 further has a shank portion 321 extending through the inner space 22 in the movable valve body 23, and a head portion 322 enlarged in cross section from the shank portion 321, received fittingly and sealingly in the upper end 242 of the inner space 22 in the movable valve body 23 when the movable valve body 23 is disposed at the first position (see FIG. 3), and disposed outwardly of the upper end 242 of the inner space 22 in the movable valve body 23 when the movable valve body 23 is disposed at the second position (see FIG. 4).

Preferably, the upper end 115 of the container 11 has a recess 114 adapted to receive an open end of a cap 4 for preventing undesired pressing of the press seat 20 when fluid dispensing is not intended.

Preferably, the movable valve body 23 is made from a flexible material, such as polyethylene (PE). The discharging tube 32 is preferably made from a hard material, such as polypropylene (PP). In an initial state, the valve body 23 is disposed at the first position (see FIG. 3), where the height (H1) between the upper end 311 of the plunger 30 and the lower end 24 of the movable valve body 23 is slightly greater than or equal to the height (H2) between a lower end 3271 of the outlet 327 and an upper end 3251 of the head portion 322 of the discharging tube 32. In operation, a force is applied on the press seat 20 so as to cause downward movement of the movable valve body 23 relative to the discharging tube 32 and the piston 31 from the first position to the second position to open the outlet 327 of the discharging tube 32, and to permit the lower end 24 of the movable valve body 23 to abut against the upper end 311 of the plunger 30. When the movable valve body 23 is moved to the second position, further pressing of the press seat 20 results in downward movement of the movable valve body 23 together with the discharging tube 32 and the piston 31 which is in contact with the fluid, thereby pushing the fluid to flow through the fluid passage 325 and the outlet 327 of the discharging tube 32. During dispensing of the fluid, the pressing action causes the lower skirt 316 of the piston 31, which is made from the flexible material, to flare outward toward the inner wall 113 of the container 11, which, in turn, results in tight sealing between the lower skirt 316 and the inner wall 113 of the container 11 so as to prevent fluid leakage therefrom. During pressing of the press seat 20, the coil spring 33 accumulates an urging force for restoring the movable valve body 23 to the first position, where the movable valve body 23 blocks the outlet 327 of the discharging tube 32 and where the lower end 24 of the valve body 23 is spaced apart from the upper end 311 of the plunger 30.

Figure 6:
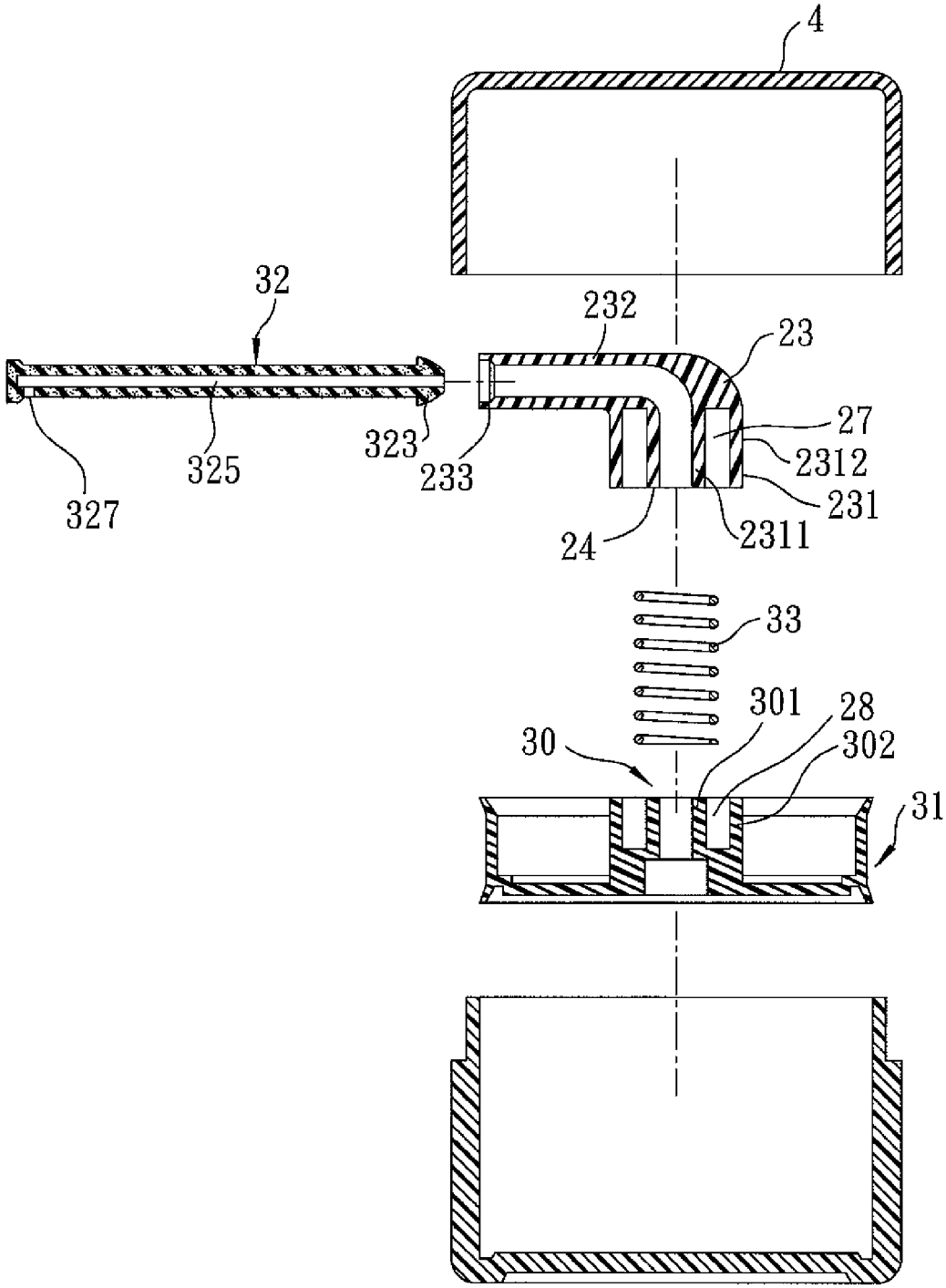
FIG. 6 is an exploded sectional view of the second preferred embodiment of a fluid dispenser according to this invention.
Figure 7:
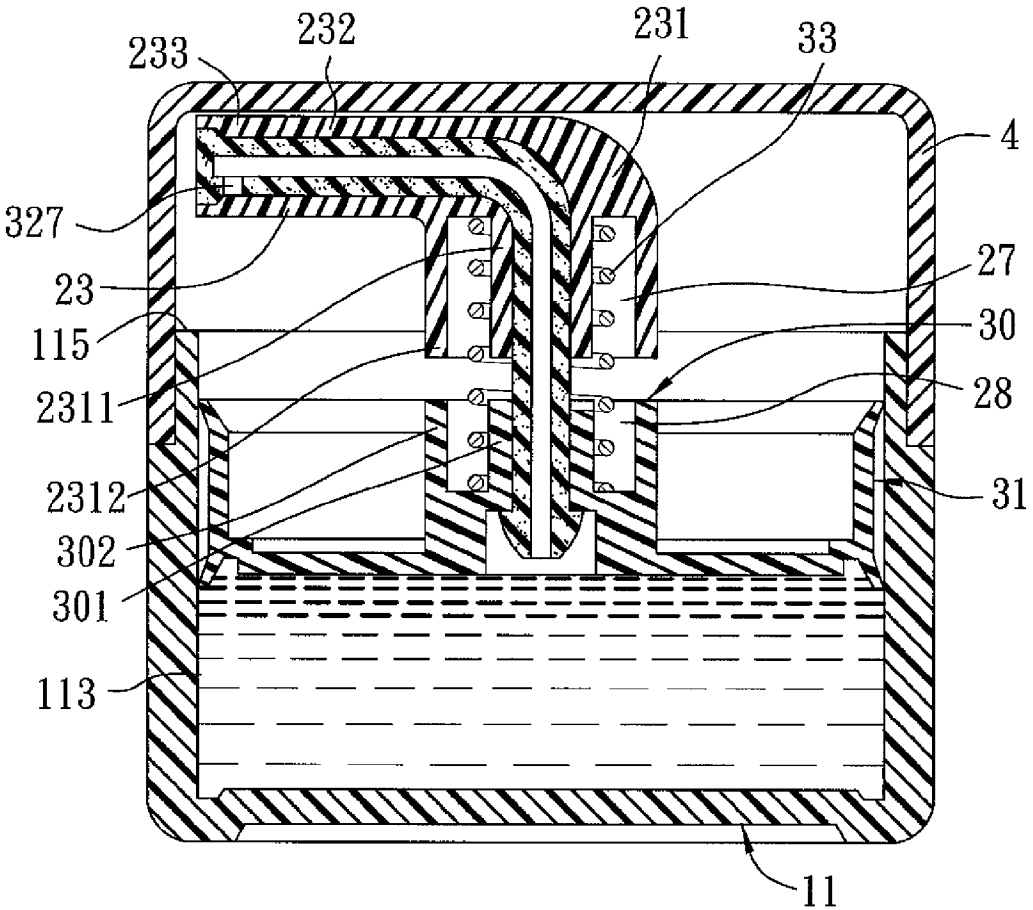
FIG. 7 is an assembled sectional view of the second preferred embodiment, illustrating a state where a movable valve body is disposed at a blocking position.
Figure 8:
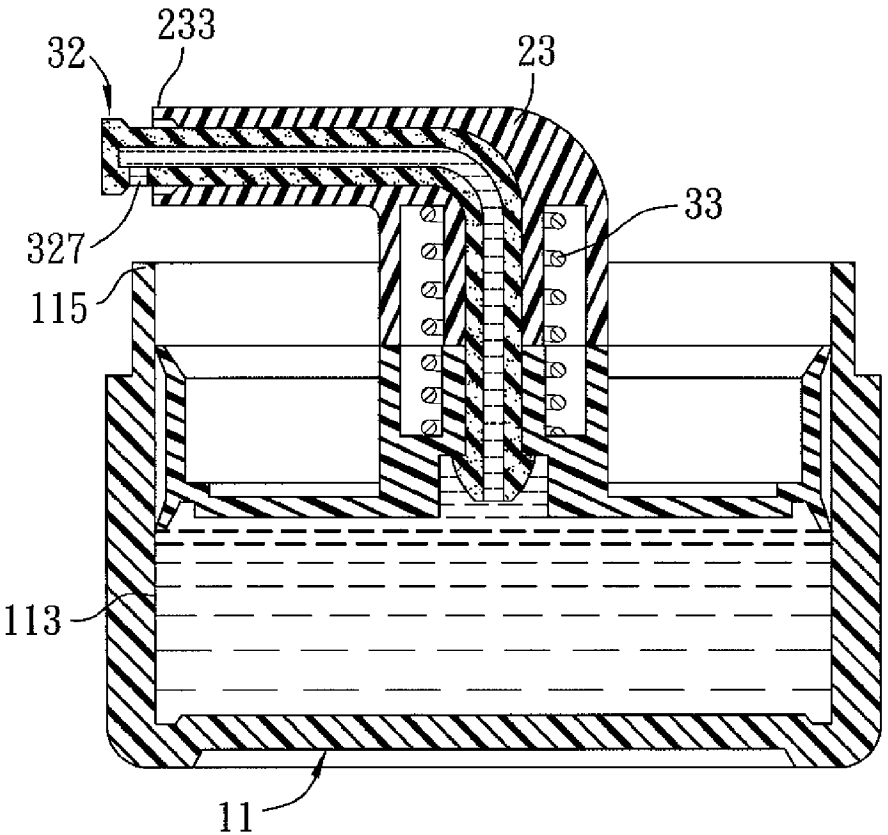
FIG. 8 is an assembled sectional view of the second preferred embodiment, illustrating another state where the movable valve body is disposed at an unblocking position.

As shown in FIGS. 6 to 8, the second preferred embodiment of the fluid dispenser according to the present invention has a structure similar to that of the previous embodiment. The main difference between this embodiment and the previous embodiment resides in the structure of the movable valve body 23.

In this embodiment, the movable valve body 23 is L-shaped and has a first segment 231 extending in a normal direction relative to the piston 31, and a second segment 232 extending from the first segment 231 in a transverse direction relative to the first segment 231 and having a free end 233 distal from the first segment 231. The outlet 327 of the discharging tube 32 is disposed adjacent to the free end 233 of the second segment 232 and faces downwardly. The first segment 231 defines the lower end 24 of the movable valve body 23. The discharging tube 32 is resilient and flexible, and extends through the first and second segments 231, 232.

In this embodiment, the first segment 231 of the movable valve body 23 has inner and outer rings 2311, 2312 that cooperatively define an upper retaining groove 27 therebetween. The plunger 30 has inner and outer rings 301, 302 that cooperatively define a lower retaining groove 28 therebetween. The urging member 33 is in the form of a coil spring 33 received in the upper and lower retaining grooves 27, 28 and sleeved on the inner ring 2311 of the first segment 231 of the movable valve body 23 and the inner ring 301 of the plunger 30.

In this embodiment, the cap-like press seat 20 of the previous embodiment is replaced by the second segment 232 of the movable valve body 23. In addition, the free end 233 of the second segment 232 of the movable valve body 23 is substantially flush with the inner wall 113 of the container 11 (see FIG. 7). Hence, the outlet 327 of the discharging tube 32 can be aligned with a portion of the upper end 115 of the container 11 in the normal direction when the movable valve body 23 is disposed at the second position (see FIG. 8), thereby facilitating discharging of the fluid into the hand of a user.

By disposing the coil spring 33 outwardly of the fluid passage 325, the aforesaid fluid contamination problem associated with the conventional fluid dispenser can be eliminated. Moreover, the outlet 327 is constantly blocked by the movable valve body 23 when the fluid dispenser is not in a dispensing state, thereby reducing the deterioration rate of the fluid caused by exposure to the ambient air.

With the invention thus explained, it is apparent that various modifications and variations can be made without departing from the spirit of the present invention. It is therefore intended that the invention be limited only as recited in the appended claims.

What is claimed is:

1. A fluid dispenser comprising:

a container defining a chamber adapted to receive a fluid therein;

a discharging tube extending into said chamber, defining a fluid passage in fluid communication with said chamber, and having an outlet disposed outwardly of said chamber and in fluid communication with said fluid passage;

a movable valve body disposed outwardly of said chamber and sleeved and slidable on said discharging tube relative to said container between a first position, in which said movable valve body blocks said outlet of said discharging tube, thereby preventing the fluid from flowing from said chamber through said fluid passage and said outlet of said discharging tube, and a second position, in which said movable valve body unblocks said outlet of said discharging tube, thereby permitting the fluid to pass from said chamber through said fluid passage and said outlet of said discharging tube; and an urging member disposed outwardly of said fluid passage and biasing said movable valve body for restoring said movable valve body to the first position;

wherein said container has top and bottom ends, and is provided with a piston that is disposed movably in said container between said top and bottom ends of said chamber, and that confines sealingly a top side of said chamber, said piston being provided with a hollow plunger extending therefrom and disposed outwardly of said chamber, said movable valve body having a lower end, said plunger being sleeved on said discharging tube and having an upper end that is axially spaced apart and that is disposed below said lower end of said movable valve body when said movable valve body is disposed at the first position, and that abuts against said lower end of said movable valve body when said movable valve body is disposed at the second position.

2. The fluid dispenser of claim 1, wherein said plunger includes an upper portion sleeved on said discharging tube, and a lower portion enlarged in cross section from and cooperating with said upper portion to define a first shoulder therebetween, said discharging tube having a lower portion disposed in said lower portion of said plunger and formed with a second shoulder disposed below said first shoulder, said first shoulder having an inner wall abutting against said second shoulder.

3. The fluid dispenser of claim 2, wherein said urging member is in the form of a coil spring sleeved on said movable valve body and said plunger and abutting against said first shoulder.

4. The fluid dispenser of claim 3, wherein said container has an inner wall, said piston having a peripheral wall having upper and lower skirts in sealing contact with said inner wall of said container.

5. The fluid dispenser of claim 4, wherein said movable valve body further has an upper end, said fluid dispenser further comprising a cap-like press seat extending from said upper end of said movable valve body and having a central part and a peripheral end in sliding contact with said inner wall of said container, said coil spring abutting against said central part.

6. The fluid dispenser of claim 5, wherein said movable valve body defines an inner space that has an enlarged upper end, said discharging tube further having a shank portion extending through said inner space in said movable valve body, and a head portion enlarged in cross section from said shank portion, received fittingly in said upper end of said inner space in said movable valve body when said movable valve body is disposed at the first position, and disposed outwardly of said upper end of said inner space in said movable valve body when said movable valve body is disposed at the second position.

7. The fluid dispenser of claim 1, wherein said movable valve body is L-shaped and has a first segment extending in a normal direction relative to said piston, and a second segment extending from said first segment in a transverse direction relative to said first segment and having a free end distal from said first segment, said outlet of said discharging tube being disposed adjacent to said free end of said second segment, said discharging tube being resilient and flexible and extending through said first and second segments.

8. The fluid dispenser of claim 7, wherein said first segment of said movable valve body has inner and outer rings that cooperatively define an upper retaining groove therebetween, said plunger having inner and outer rings that cooperatively define a lower retaining groove therebetween, said urging member being in the form of a coil spring received in said upper and lower retaining grooves and sleeved on said inner ring of said first segment of said movable valve body and said inner ring of said plunger.

* * * * *